US006282870B1

(12) United States Patent
Robache

(10) Patent No.: US 6,282,870 B1
(45) Date of Patent: Sep. 4, 2001

(54) PROCESS AND DEVICE FOR PACKAGING PRODUCTS AND CORRESPONDING PACKAGING BOXES

(75) Inventor: Patrick Robache, Paris (FR)

(73) Assignee: Mecaplastic, Champigny sur Marne (FR)

( * ) Notice: Subject to any disclaimer, the term of this patent is extended or adjusted under 35 U.S.C. 154(b) by 0 days.

(21) Appl. No.: 09/419,802

(22) Filed: Oct. 18, 1999

(30) Foreign Application Priority Data

Oct. 16, 1998 (FR) ..... 98 12981

(51) Int. Cl.[7] ..... B65B 47/00

(52) U.S. Cl. ..... 53/453; 53/455; 53/456; 53/561; 53/377.6

(58) Field of Search ..... 53/453, 559, 561, 53/377.6, 455, 456, 329.3, 478

(56) References Cited

U.S. PATENT DOCUMENTS 4,364,220 12/1982 Rausing .
4,387,551 * 6/1983 Cowan ..... 53/478
5,007,231 * 4/1991 Ingemann ..... 53/412
5,009,056 * 4/1991 Porteous ..... 53/412
5,369,937 * 12/1994 Logothetis ..... 53/453
5,419,096 * 5/1995 Gorlich ..... 53/478
5,496,250 * 3/1996 Fielder et al. ..... 53/453
5,603,203 * 2/1997 Robache ..... 53/559

FOREIGN PATENT DOCUMENTS 0 025 621 3/1981 (EP) .
0 652 155 5/1995 (EP) .

* cited by examiner

*Primary Examiner*—Peter Vo
*Assistant Examiner*—Sam Tawfik
(74) *Attorney, Agent, or Firm*—Young & Thompson

(57) ABSTRACT

A process and a device for packaging products in thermoformed boxes, uses a single strip of thermoplastic or thermoformable material to produce cavities (B) and covers (A) and to fold them down (13) about the product to be packaged before thermowelding (14) their edges.

4 Claims, 4 Drawing Sheets

PROCESS AND DEVICE FOR PACKAGING PRODUCTS AND CORRESPONDING PACKAGING BOXES

This application corresponds to French application 98.1298 of Oct. 16, 1998, the disclosure of which is incorporated herein by reference.

BACKGROUND OF THE INVENTION

The present invention relates to a process for packaging products, particularly food, chemical or pharmaceutical products, to a device for practicing said process, as well as for a packaging box for products.

There are known numerous processes and apparatus for packaging products. Generally, there are used two rolls of strips of deformable material, the first strip being adapted to be shaped to constitute cavities and the second strip being adapted to be welded on the periphery of the cavities to constitute a lid and a sealed assembly protecting the food, chemical or pharmaceutical products contained in the cavities.

The preservation of the products can be prolonged by packaging the products under vacuum or under an inert atmosphere, by injection of a neutral gas at the welding station.

The document EP-0-652-155 A1 discloses a process, a device and a packaging box for food, chemical or pharmaceutical products, using a first strip of thermoplastic or thermoformable material and a second strip of thermoplastic or thermoweldable material.

SUMMARY OF THE INVENTION

The invention has for its object to improve the prior art, by permitting the use solely of a single band of thermoplastic or thermoformable material to package the products in sealed boxes.

The invention has for its object a process for packaging products in thermoformed boxes, from a single strip of thermoplastic or thermoformable material, comprising the steps of thermoforming cavities and associated covers in said strip, cutting along three sides about the covers, loading the cavities with products, pressing down the covers over the cavities and thermowelding the covers to the cavities to constitute boxes constituting said products.

According to other characteristics of the invention:

the process moreover comprises a step of pre-cutting between cavities and associated covers, to leave one or several attached portions forming a folding hinge;

the process moreover comprises a step of cutting out edges bordering the thermowelded cavities to the covers, to free individually one or several boxes containing said products.

The invention also has for its object a device for packaging products in thermoformed boxes, by using a single strip of thermoplastic or thermoformable material, comprising means for thermoforming cavities and associated covers in said strip, means for cutting out along three sides about said covers, means for loading the cavities with products, means for pressing down the covers over the cavities and means for thermowelding the covers to the cavities to constitute boxes containing said product;

according to other characteristics of the invention:

the device comprises means for pre-cutting out between cavities and associated covers to leave one or several attached portions forming hinges for folding.

the device comprises means for cutting out edges forming the thermowelded cavities to the covers.

the pressing down means for the covers over the cavities comprise at least one retractable rotatable finger.

the means for pressing down the covers over the cavities are preadjusted to raise the covers and to fold them down from an angle greater than 90° of arc.

The invention also has for its object a packaging box for products obtained by the practice of the process according to the invention by using a device according to the invention.

According to other characteristics of the invention, the cavity and the cover have edges having separate contours, so as to provide two tongues adapted to be spaced to facilitate opening the box.

BRIEF DESCRIPTION OF THE DRAWINGS

The invention will be better understood from the description which follows, given by way of non-limiting example, with reference to the accompanying drawings, in which.

DESCRIPTION OF THE PREFERRED EMBODIMENTS

Figure 1:
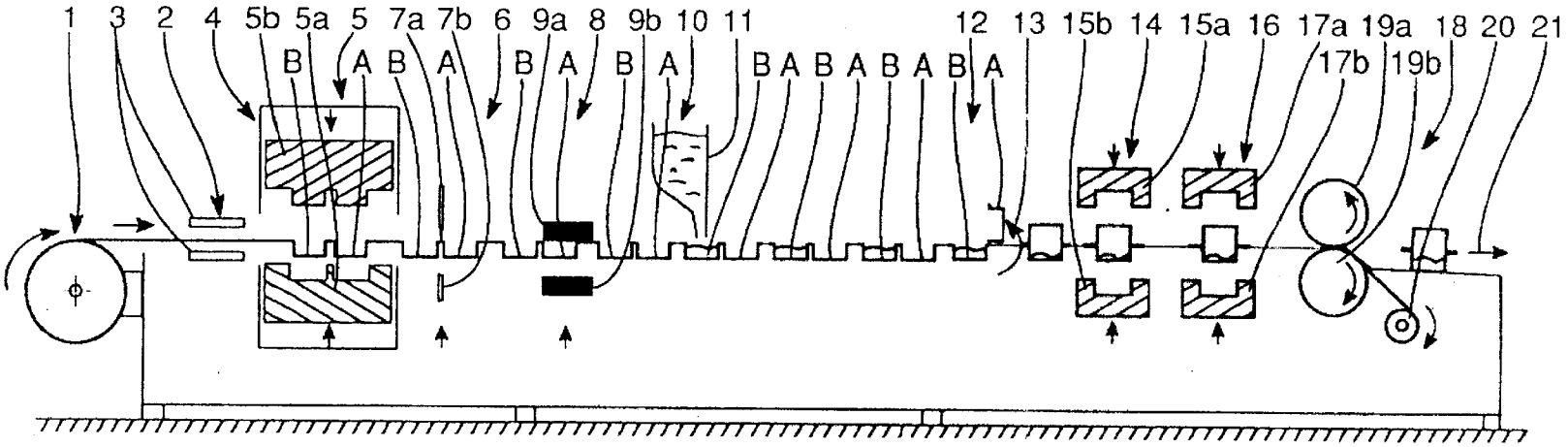
FIG. 1 shows schematically a longitudinal cross-sectional view of a device according to the invention.
Figure 2:
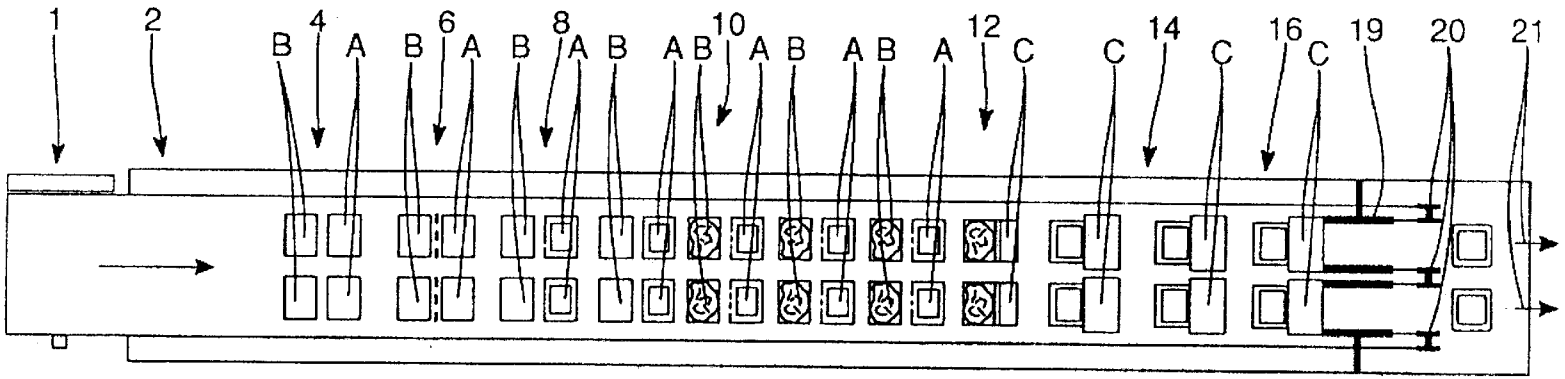
FIG. 2 shows schematically and partially a plan view of the device according to the invention.

Referring to FIGS. 1 and 2, a device according to the invention is constituted by an assembly line of operative modules supported by carrying chassis to process a single band of thermoplastic or thermoformable material unrolled from a roll 1.

The end of the unrolled band from the roll 1 is driven by horizontal chains on links on which are mounted grippers for the strip of plastic material, so as to drive the strip of thermoplastic material stepwise corresponding to the advance of the strip from the roll in successive cycles of the process according to the invention.

Gripping and driving means for the first strip of thermoplastic material constituted by horizontal chains are known per se, particularly from the document FR 2.027.741 in the name of the present assignee, and do not require a more particular description.

The thermoplastic strip from the roll 1 is unrolled flat to arrive at a first region 2 adapted to receive a device 3 for preheating the strip of thermoplastic material. The preheating is carried out for example by means of one or several metal plates having good thermal conductivity. In at least one of the metallic plates is embedded a heating element, for example a shielded resistance electrically insulated relative to the metal plate.

At the outlet of zone 2 which does the preheating, the strip of thermoplastic material advances by successive steps into a thermoforming zone 4 comprising a thermoforming module 5.

The thermoforming technique used in the thermoforming zone 4 is for example the thermoforming technique called "negative simple", a technique most often used in which there is first carried out a heating of the strip of material to be thermoformed by applying it in contact with a heating plate 5*a*, then the deformation properly so called by blowing compressed air through an upper heating plate 5*b* provided for this purpose with suitable openings.

Alternatively, the thermoforming module 5 could be according to the so-called "negative with mechanical assistance" technique, in which technique the heating of the film takes place by contact on opposite sides of the latter by sandwiching it between two thermally regulated plates, if desired at different temperatures, then by descent of a piston for example a metallic piston to pre-stretch the preformed strip of material and finally by applying the thermoplastic strip against the mold by injection of air or compressed gas through the piston provided for this purpose wit h suitable openings.

Finally, in the case of more rigid materials, the thermoforming module 5 is preferably according to the so-called "positive with blistering" technique in which there is first carried out the heating by contact between two thermally regulated plates, then the strip of thermoplastic material is deformed by suction in the lower portion of the tool so as to pre-stretch the film or the thermoplastic strip and finally there is carried out pressing, which is to say pressing the film against the mold which is lowered for this purpose or to the level of the thermoplastic strip. In this blistering technique, known per se, there are preferably obtained vertical walls of regular shape with angles of the packaging box of a thickness sufficient to avoid any ultimate piercing.

It is essential that there is performed during thermoforming successive pairs of cover A and cavity B associated in the strip of thermoformable material unrolled from the roll 1.

In the non-limiting example shown, the thermoforming line is constituted by a double line permitting the simultaneously packaging in parallel of two boxes.

At the outlet of the thermoforming zone 4 a transverse pre-cutting-out zone 6 is provided to constitute a hinge between cavity B and cover A. A knife 7*a* and an anvil 7*b* coact for this purpose to provide a cut transverse to the direction of advance of the strip, leaving two or three attached regions between cavity B and cover A.

A cutting-out zone 8 with three sides is adjacent to the zone 6 for pre-cutting-out, to provide a cut surrounding each cover A on three sides by means of a knife with two blades 9*a*, 9*b* having a U-shaped contour.

Each hollow cover A is then detached from the band on three side by being solely connected to the strip of thermoformable material by the mentioned attachment regions.

Guide beams or rods (not shown) are preferably provided to support and guide the covers A driven in an advancing direction by successive steps of the strip of thermoplastic material.

At the outlet of the zone 8 for cutting out in a U shape about three sides, the cavities B are filled in a zone 10 for filling with products to be packaged, either manually or by pouring or dosing apparatus 11.

After filling, the covers A are folded over the cavities B about the mentioned attachment regions in a folding zone 12 by folding means 13 for the covers.

As folding means 13 for the covers can be used rotating swinging fingers adapted to raise the bottoms of the covers A through an angle greater than 90°, for example of the order of 120°, sufficiently to obtain closure of the cover A by falling under the influence of gravity about the remaining attachment regions.

In FIG. 2, in which the mechanical elements located above the thermoformable strip have not been shown for purposes of clarity, it will be seen that the folding of the covers A in the zone 12 causes the cutout contours C to appear in the thermoformable strip.

The folded covers A and cavities B are then moved into a welding zone 14, in which two welding heads 15*a*, 15*b* are applied to the edges of the cover A and the cavity B to weld them in a manner to achieve a sealed joint.

As the type of welding that can be used, can be envisaged a welding with a flat strip, a weld with a radiating strip, a flat weld, a flanged weld or a diamond-pointed weld. In the zone 14, the thermal welding module 15*a*, 15*b* if desired incorporates a module for placing under vacuum as a function of the nature of the materials to be welded and the products to be contained (thus, for certain emulsified or high liquid content products, only a partial vacuum can be drawn for fear of causing the packaged product to boil).

The thermal welding module 15*a*, 15*b* can also integrate as a supplemental or replacement for the module for placing under vacuum, a module for re-injection operating according to one or another of the following systems:

- the system for re-injection by a nozzle in which the cover A is maintained in the half-opened position to permit re-injection of gas and in which there is used a nozzle located within the welding tool and carrying out re-injection of gas within the cavity B
- or alternatively the technique of re-injection by so-called "pasting", in which the previously thermoformed strip cut out by a "pasting" module permits carrying out a re-injection of gas by means of conduits located in a central position or in a lateral position of a welding mold, conduits through which the re-injection gas flows through the location in the form of a pastille cut out from the thermoformed strip.

At the outlet of the thermal welding zone 14, the sealed boxes containing the packaged product are cooled in a cooling zone 16, in which two cooling frames 17*a*, 17*b* cool the boxes, and in particular the edges of the box which have been welded in the zone 14.

In this step, the cooled boxes are still secured to the thermoplastic strip, because the edges of the cavities B have not been detached from the thermoplastic strip.

This separation is carried out in final cutting zone 18 by means of slicing discs 19*a*, 19*b* that counter-rotate. The discs 19*a*, 19*b* cut out the scrap from the edges of cavities B, which is then rolled up on recovery drums 20.

Because of the transverse separations corresponding to the cut-out contours, it suffices to use a longitudinal slice (in the direction of movement of the thermoplastic strip) by means of discs 19*a*, 19*b* to separate individually each box of packaged product and to remove it in the direction of the arrows 21.

Figure 3:
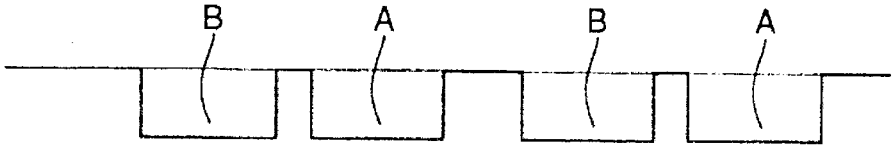
FIGS. 3 to 8 show schematically the successive steps of a packaging process according to the invention.

With reference to FIGS. 3 to 8 showing successive views of the thermoplastic strip viewed in transverse cross-section, there is shown in FIG. 3 a thermoforming phase of the zone 4 provided in the module 5 to form simultaneously a cavity B and a cover A in the strip of thermoplastic material advancing step by step according to a pitch of advance predetermined as a function of the dimensions of the corresponding mold.

Figure 4:
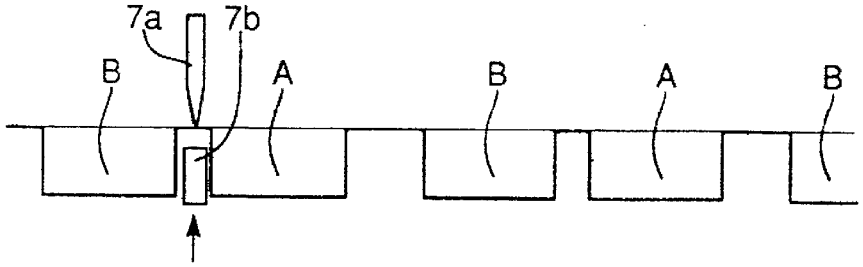

In FIG. 4, there is carried out the transverse cut of the zone 6 by means of the punch 7*a* and the anvil 7*b*, so as to leave weak attachments between the cover A and the associated cavity B.

Figure 5:
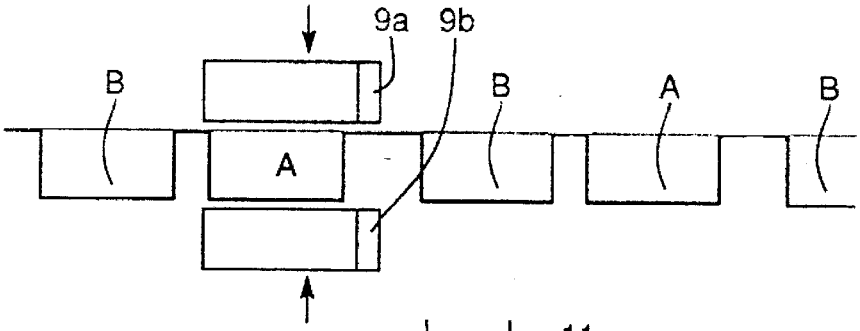

In FIG. 5, there is carried out the surrounding cutout in U shape of the zone 8 about three sides, by means of the punch

9*a* which cuts out in U shape and the anvil 9*b*, so as entirely to detach the three sides corresponding to the external edge of the covers A.

Figure 6:
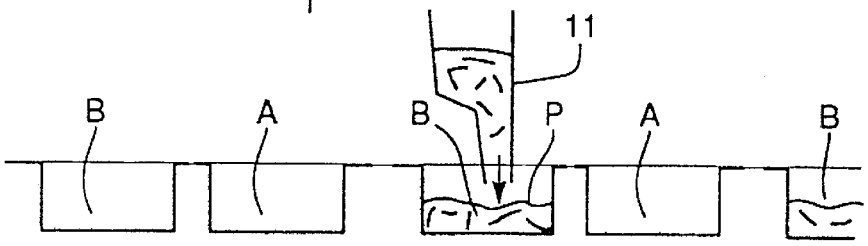

In FIG. 6, there is carried out the filling of the cavities B by a product P. The product P at least partially fills each cavity B without however overflowing it. Various filling means can be provided at the filling station 10, for example the use of an apparatus 11 for filling with product P.

Figure 7:
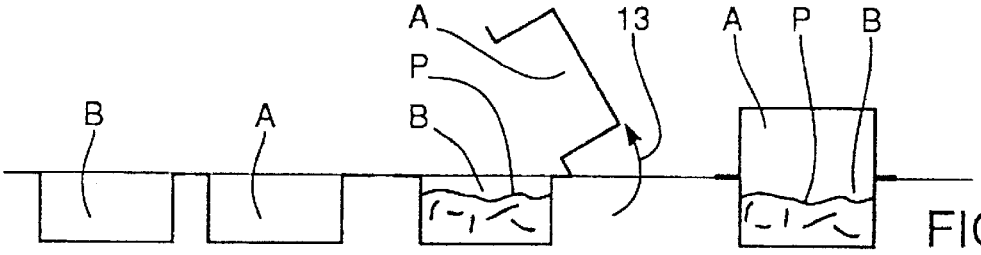

In FIG. 7, there is carried out in the zone 12 the folding of the covers A over the cavities B about points of attachment providing a hinge. A folding means 13, for example a pusher finger retractable upon each step of advancement, acts preferably on the bottoms of the covers A, so that the edges of the cover A are applied against the edges of the cavity B.

Figure 8:
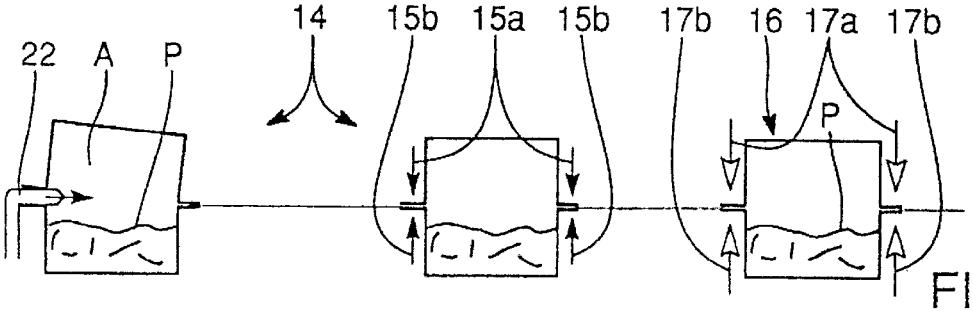

In FIG. 8, there is carried out at a thermowelding station 14 a possible vacuum application or an injection of neutral gas by means of a nozzle 22 for injection through the half-opened box, then there is carried out the thermowelding of the edges with the aid of thermowelding frames 15*a*, 15*b*.

Then the welded boxes are cooled and in particular their welded edges, at the cooling station 16 with the help of cooling frames 17*a*, 17*b*.

Figure 9:
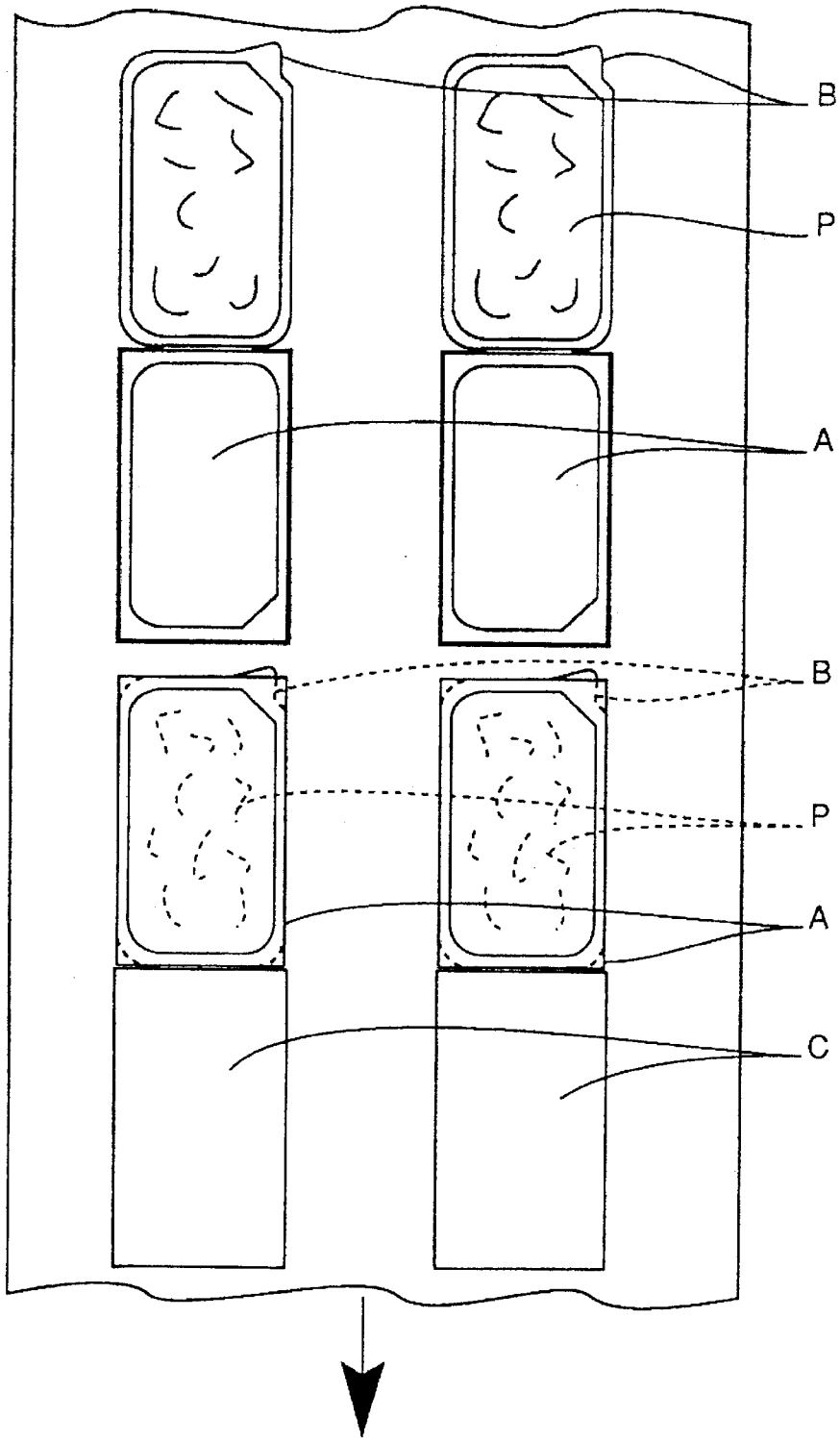
FIG. 9 shows schematically a plan view representing the practice of the invention.

FIG. 9 shows a preferred embodiment of the invention and illustrates with identical reference numerals to those in the preceding figures, the use of the invention by folding the covers over the cavities B filled with product P, so as to disengage in the thermoformed strip contours C cut out by separation between successive boxes.

Figure 10:
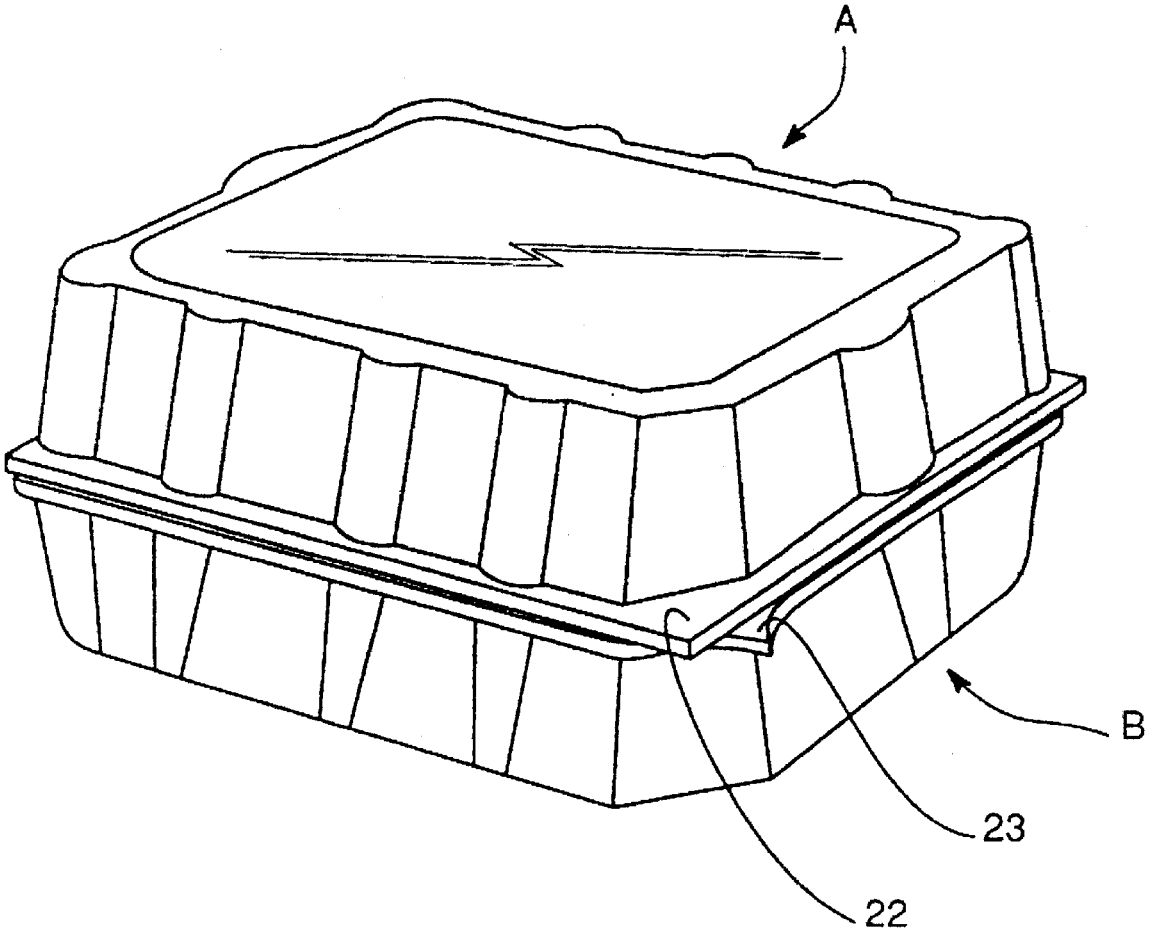
FIG. 10 shows a perspective view of a packaging box according to the invention.

FIG. 10 shows schematically a preferred embodiment of box according to the invention.

The cover A has rectangular edges 22 which extend beyond the rounded edges of the cavity B whilst the cavity B has a tongue 23 adapted to be spaced from the corner 22 to permit by simple traction easy opening of the box.

The invention described with reference to one particular embodiment is not in any way limited, but on the contrary covers all modifications of shape and any variation of embodiment within the scope and spirit of the invention, permitting the use of a single strip of thermoformable material to package a product in boxes each assembled in a sealed manner from a cavity and a cover.

What is claimed is:

1. A process for packaging a product in thermoformed boxes from a single strip of thermoplastic or thermoformable material, comprising the steps of:

thermoforming successive pairs of cavities and associated covers in said single strip;

cutting out three sides of the covers;

loading the cavities with product;

folding the associated covers over the cavities; and thermowelding the associated covers to the cavities to constitute boxes containing the product while leaving the boxes secured to the single strip in order to be transported to a final separation zone.

2. The process as claimed in claim 1, further comprising the step of partially cutting between the associated cavities and covers to form weakened hinges between the associated cavities and covers.

3. The process as claimed in claim 1, further comprising the step of cutting out the cavities thermowelded to the covers to free individual boxes from a remaining scrap of the single strip.

4. The process as claimed in claim 3, further comprising the step of winding up the remaining scrap in a roll.

* * * * *